US005337903A

United States Patent [19]

Wolcovitch et al.

[11] Patent Number: 5,337,903

[45] Date of Patent: Aug. 16, 1994

[54] DISPLAY SYSTEM

[76] Inventors: Brian Wolcovitch, 189 Brooke Ave., Toronto Ontario, Canada, M5M 2K7; Frank Fumagalli, 277 Chelwood Dr., Thornhill, Canada, L4J 7R6

[21] Appl. No.: 915,228

[22] Filed: Jul. 20, 1992

[51] Int. Cl.[5] ..... A47F 7/00

[52] U.S. Cl. ..... 211/13; 211/87; 211/94

[58] Field of Search ..... 211/13, 87, 94; 248/902, 220.2, 223.4

[56] References Cited

U.S. PATENT DOCUMENTS

| | | | |
|---|---|---|---|
| 3,229,944 | 1/1966 | Everburg | 248/902 |
| 4,572,381 | 2/1986 | Breakey et al. | 248/223.4 |
| 4,694,965 | 9/1987 | Parnell | 211/189 |
| 4,891,897 | 1/1990 | Gieske et al. | 211/189 |
| 4,944,416 | 7/1990 | Petersen et al. | 211/94 |
| 4,989,815 | 2/1991 | McAuley | 211/13 |
| 5,138,803 | 8/1992 | Grossen | 211/94 |

*Primary Examiner*—P. Austin Bradley
*Assistant Examiner*—Chuck Y. Mah

[57] ABSTRACT

A display system comprises an elongate arm having a flange at one end and a holder at the other end for receiving and supporting an object to be displayed, and a display panel having a generally upright front face. At least one slot is located in said panel and is accessible from said front face. Each slot extends at least partially across the front face of the panel. Each of said slots are adapted to receive said flange through said front face in a compression fit to removably retain and support the holder in a spaced relationship from said front face. Lateral extensions of the flange on an arm may act as spacers for providing a minimum lateral spacing between adjacent arms in a slot. Where said object is an eyeglass frame, said holder includes a frame retaining means comprising a raised portion intermediate the ends of the holder to prevent the frame from sliding along the holder.

15 Claims, 5 Drawing Sheets

DISPLAY SYSTEM

FIELD OF THE INVENTION

This invention relates to a display system for objects, and in particular relates to a modular display system for eyeglasses.

BACKGROUND OF THE INVENTION

A variety of display systems are used in retail outlets and the like to display a broad range of goods. Large or heavy items (for example, T.V., microwave ovens, etc.) are commonly displayed stored on shelving or are stacked on floors for the efficient use of store space. However, for smaller and lighter items, such as jewelry, watches, glasses, toiletties, small electronic (for example, calculators) and hardware items, shoes and cloths, a display system which displays such items in multiple horizontal layers, say along a wall, is preferable for effective use of retail space.

In the case of display systems for eyeglasses, several different systems exist. Typically, eyeglass display systems comprise two main components: a series of long and slender brackets or rods, vertically mounted and laterally spaced on a wall or the like; and numerous carriers or arms mountable on the brackets for supporting and displaying the eyeglasses. The brackets have vertically spaced apertures at pre-set intervals for receiving a rear end, or hook end, of each arm. The front end of each arm has a holder or shelf for receiving the eyeglasses.

Such display systems suffer from several disadvantages. Mounting the hook end of the arm into the bracket apertures is cumbersome and difficult, especially if the apertures are obscured from view by some panelling or outer display surface. The arms can and often do slip out of the apertures if not properly secured. The hook ends also tend to break near the arm/-bracket interface. The construction of the brackets restricts the versatility of the system by providing a limited and pre-set number of positions for the arms. The lateral spacing of the arms is unalterable once the brackets are set up, hence the lateral spacing can not be readily altered for different sized display objects to avoid interference between the objects, for example. This also severely limits the number of different displays which can be set up with a given number of brackets and arms.

One attempt in the prior art to overcome some of the above problems has been a display system comprising an upright backboard made of a relatively soft material, such as dense foam, and mountable arms. The rear end of each arm is in the form of a spike adapted to be driven into the backboard by the person setting up the display. Although this system has greater spacial flexibility for placing the arms on the display surface and provides a greater variety of display set-ups, the resulting displays tends to have an unorganized and "messy" look. The arms are difficult to align in any straight line or other symmetrical pattern, and the orientation of each arm to the board varies depending on how it was spiked into the backboard. Furthermore, any near-alignment which is achieved is quickly disturbed by users of the display as eyeglasses are repeatedly removed and returned to the arms. Eventually, these disturbances tend to dislodge the arm from the backboard.

Another variant of the above display system involves the substitution of the spike with a backplate on the rear end of each arm. The backplate and backboard are fitted with a fine hook and loop arrangement, one version of which is commonly known as VELCRO TM. This display system suffers most of the same disadvantages as the above system, including the dislodging of the arm from the backboard as the arm is repeatedly disturbed.

Yet another version of a display system, sometimes referred to as SLOT WALL TM, comprises either vertical or horizontal slots or channels located in a backboard and mountable arms. The rear end of each arm employs two slightly spaced lugs. One of the lugs is adapted to be inserted into the channels through openings at the sides or edges of the backboard and is slid to a desired location in that slot. The other lug abuts the other side of the slot (i.e. the outer display surface of the backboard) and provides some resistance to movement of the arm along the slot. Some of the above discussed disadvantages for the other systems are also applicable to this display system. Another disadvantage is the impractical and restricted access to each slot, namely only from the sides of the backboard. Hence, the removal or replacement of an arm from the middle of a slot is cumbersome because all arms between the arm being removed and the end of the slot must also be removed from the slot.

Another problem common to all of the above-noted display systems is the propensity of eyeglasses to fall off of the holders at the front end of the arms. Although some of the better holders employ an inverted channel-type construction to help prevent the eyeglasses from falling off backward (i.e. toward the backboard) or forward, none employ a means to prevent the eyeglasses from sliding sideways off the holder or for centering the eyeglasses.

Lastly, none of the above arms provide a means to automatically provide a minimum spacing between adjacent arms to help avoid entanglement or interference between objects supported thereon.

What is therefore desired is a display system to overcome the disadvantages of these other display systems. Preferably it should have a means for quickly and easily mounting arms onto a display backboard in a secure manner. The system should provide guides for straight line or other symmetrical patterns, yet allow an ample spacial flexibility for arranging different display patterns. Preferably the arms have means to provide a minimum spacing between adjacent arms as well as means to help prevent the eyeglasses from slipping off the holders on the arms. The arms should be provided with alternate configurations to add further variations to the possible display patterns.

SUMMARY OF THE INVENTION

According to the present invention there is provided a display system comprising:

(i) an elongate arm having a flange at one end and a holder at the other end for receiving and supporting an object to be displayed;

(ii) a display panel having a generally upright front face; and (iii) at least one slot in said panel accessible from said front face and extending at least partly across the front face of said panel, said slot being adapted to receive said flange through said front face in a compression fit, thereby removably retaining and supporting the holder in a spaced relationship from said front face.

Preferably, the panel comprises a backing and a plurality of elongate front members connected to said backing, wherein each of said front members are spaced from one another to form said slots.

In one embodiment the system includes spacers for providing a minimum lateral spacing between adjacent arms in a slot wherein said spacers comprise lateral extensions of the flange on each arm.

Where said object is an eyeglass frame to be displayed, preferably the holder includes means for retaining the frame in the holder.

Preferably, said arms may be mounted to the panel at various angles thereto.

BRIEF DESCRIPTION OF THE DRAWING FIGURES

A preferred embodiment of the present invention is described below, by way of example only, with reference to the accompanying drawings in which.

DESCRIPTION OF THE PREFERRED EMBODIMENTS

Figure 1:
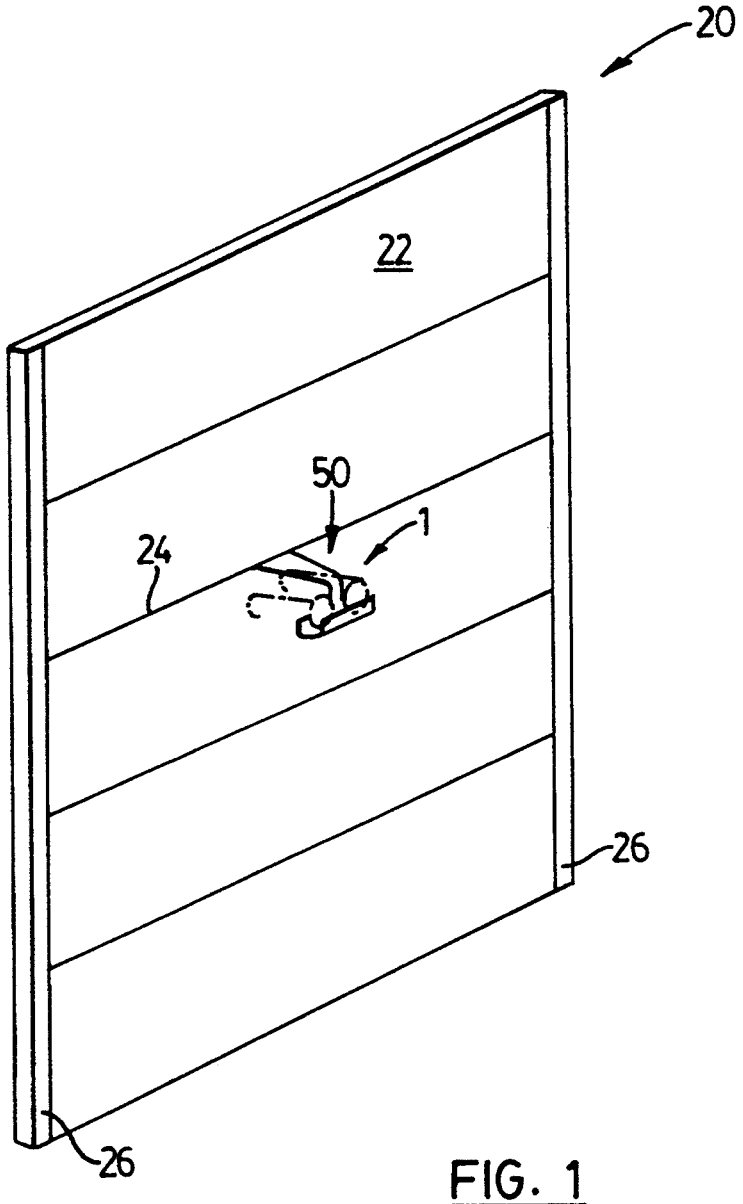
FIG. 1 is a perspective view, from the front, of a display system according to a preferred embodiment of the present invention.
Figure 2:
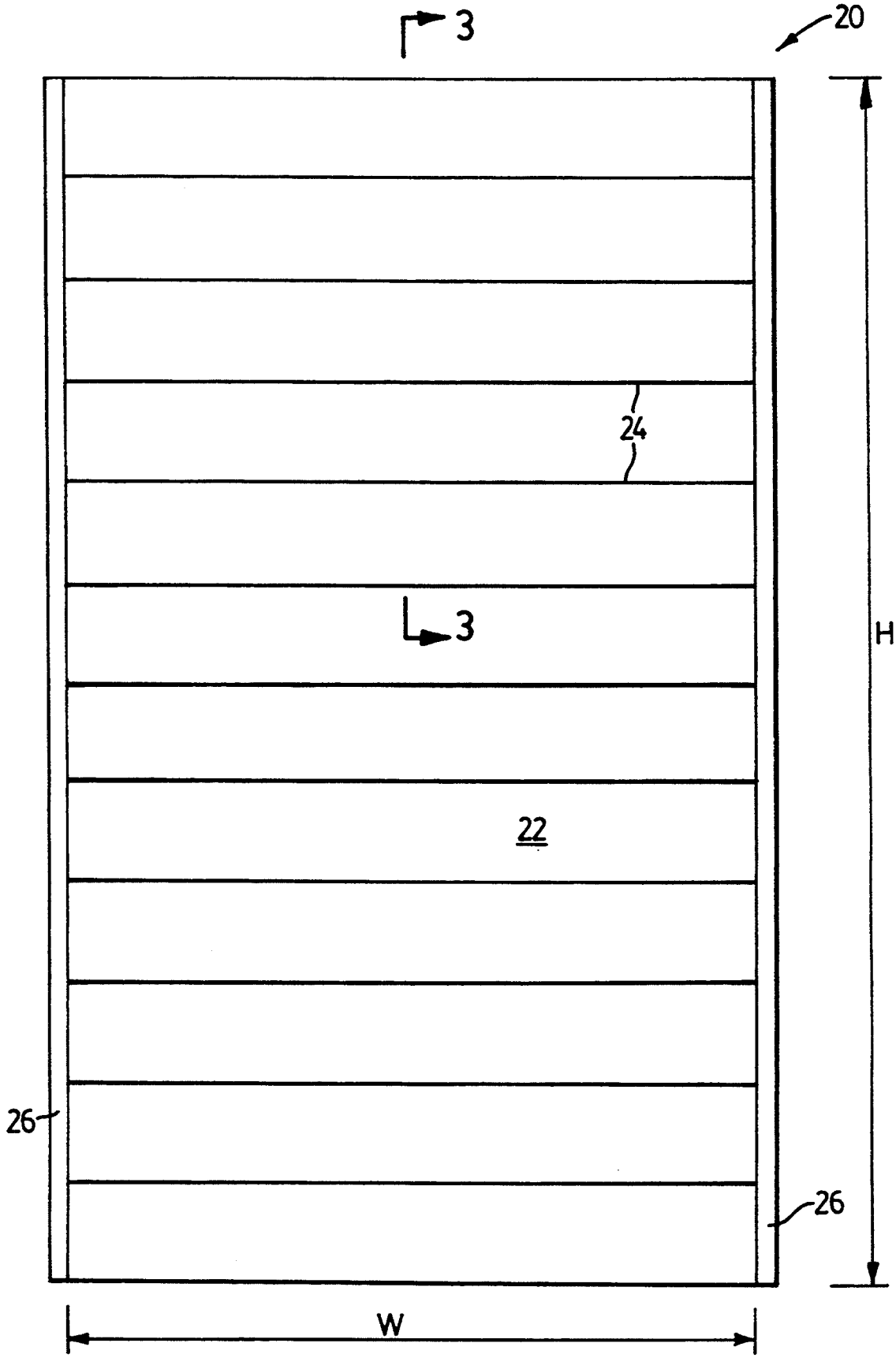
FIG. 2 is a front elevation view of a front face of a panel of the display system in FIG. 1.
Figure 3:
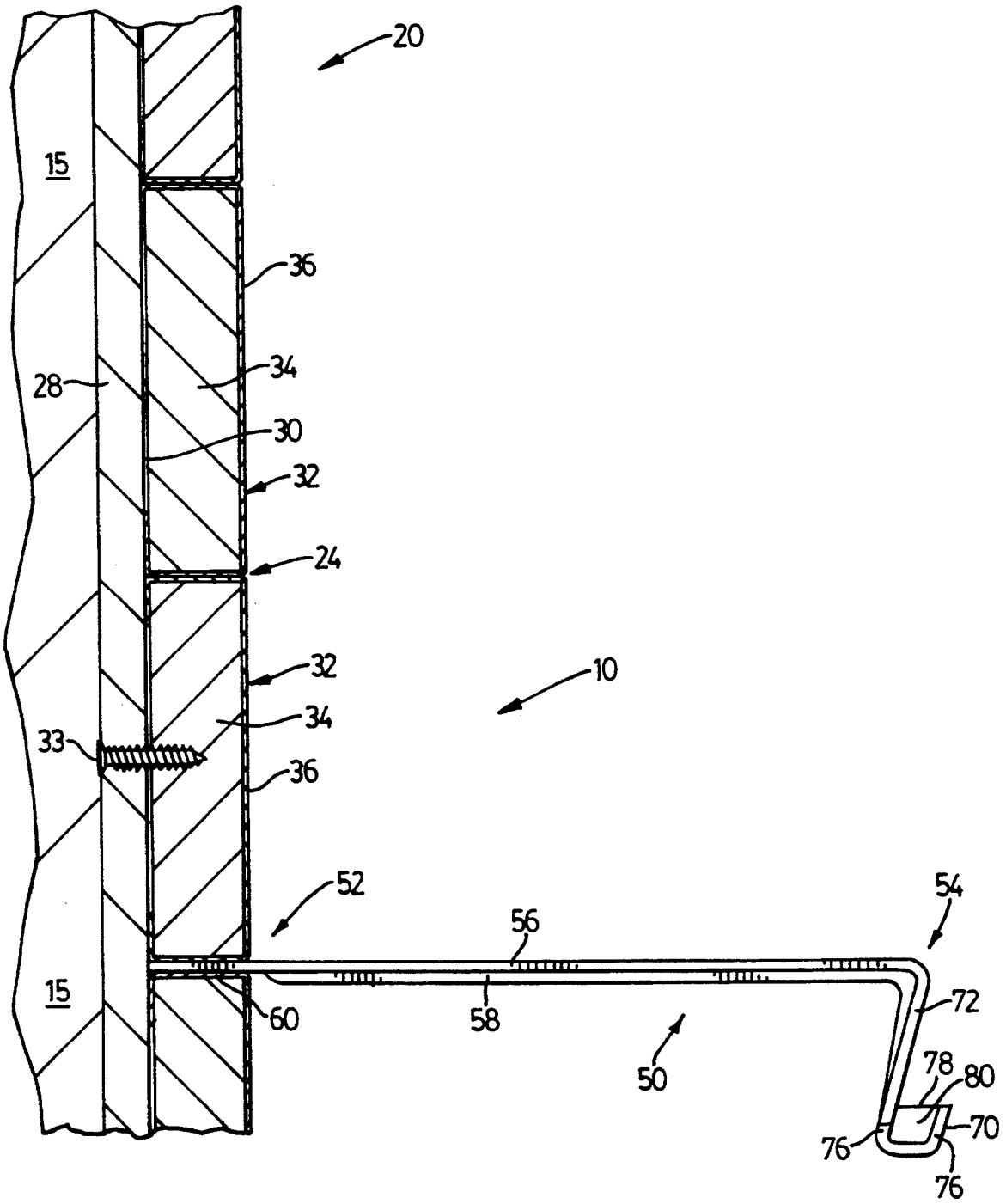
FIG. 3 is a cross-sectional view of the panel of FIG. 2, and of an arm of said display system.

Reference is first made to FIGS. 1, 2 and 3 which show a preferred embodiment of a display system, generally indicated by 10, for displaying eyeglasses 1 (shown in dotted outline). The display system 10 has two main components, namely a generally upright panel 20 and at least one elongate carrier or arm 50. A first or rear end 52 of the arm 50 is mountable to the panel 20, and a second or front end 54 of the arm 50 is adapted to support the eyeglasses 1 for display. The arm 50 is discussed in greater detail later.

As seen in FIGS. 1 and 2, the panel 20, when viewed from the front, comprises a generally vertical front face 22 having a width W and height H suited to hold a desired number of arms 50. The panel 20 is also dimensioned to fit the display system 10 into a desired space in a retail eyeglass shop, for example. The panel 20 may be mounted to a wall 15 (as is shown in FIG. 3) or may be free standing if a suitable base (not shown) is provided.

A number of spaced slots 24 are provided on the front face 22. Each slot 24 is adapted to receive the rear end 52 of the arm 50 in a compression fit to removably retain and support the arm 50 on the panel 20. Each slot 24 should be long enough to accommodate at least one arm 50, although the slots 24 will usually extend across a substantial width of the front face 22 to fit several arms 50 side-by-side. An arm 50 can be inserted into a slot 24 at any location along its length and can be slid along the slot 24 laterally as desired.An obstruction, or stop, should be provided at the ends of the slot 24 to prevent the arm 50 from accidentally slipping or sliding out of the slot. In the configuration shown in FIG. 2, the stop comprises a vertical strip 26 of wood or plastic mounted on the edges of the front face 22 and also serves a decorative purpose.

In the preferred embodiment each of the slots 24 extend generally horizontally across the front face 22. It will be appreciated that the panel 20 may be provided with spaced slots that are inclined. As will be made apparent below, any inclination of the slots 24 will depend on the configuration of the arm 50 and the nature of the object to be supported and displayed. A panel 20 could be constructed combining slots of various inclinations. It will be appreciated that for inclined slots 24, the compression fit must be adequate to prevent the arm 50 from slipping in the slot with the display object mounted thereon. In the preferred configuration of the arm 50 described herein, inclined slots are not desired for aesthetic reasons and because of the greater risk of the eyeglasses falling off the arm 50.

The slots 24 are spaced from one another to avoid interference between arms 50, and between objects mounted thereon, located on neighboring slots 24. When display 10 is to be used for eyeglasses, for example, the spacing of the slots 24 should be at least the height of the arms 50 to be used and, preferably, at least the height of the largest eyeglasses to be displayed. In the preferred embodiment, the spacing of the slots 24 is about 75 mm (4 inches). Hence, eleven slots 24 are provided in the front face 22 of the panel 20 which has a height H of about 1220 mm (48 inches). It will be appreciated that there is a very wide latitude to choosing the spacing between slots 24. For instance, the spacing need not be uniform on the panel 20.

FIG. 3 shows a portion of the panel 20 in cross-section. The panel 20 is constructed using a planar backing 28, which can be one or more sheets of 0.50 inch (12.7 mm) thick plywood placed side-by-side for example. The backing 28 is mounted to a wall 15 by suitable connectors (not shown). A number of elongate front boards 32 are mounted on an outer face 30 of the backing 28 opposite the wall 15 using screws 33. The screws 33 are passed through the backing 28 into each board 32 so as not to scar the front face 22. An alternative is to glue the boards 32 onto the outer face 30.

Each board 32 comprises an inner core 34 of generally rectangular cross section and is substantially surrounded by an outer layer 36 of relatively compressible material. The outer layer 36 may be attached to the inner core 34 in any suitable fashion, using glue or tacks, for example. In one version, the inner core 34 is 1.0 in.×4.0 in. (25.4 mm×101.6 mm) particle board which provides adequate spacing (4.0 in.) between the resulting slots 24 for displaying the eyeglasses 1. The outer layer 36 comprises one of fine hook or fine loop material such as BURFAB TM or VELCRO TM. Hence, small display signs or the like having the other of fine hook or loops can be adhered to the front face 22 for display purposes. It will be apparent that the outer layer 36 may be omitted if the inner core 34 is made of a suitable resilient material to provide the required compression fit in each slot. For example, the core 34 could be made of a stiff rubber, foam or plastic. Alternately, for example, the panel 20 and the slots 24 therein may comprise a one-piece blow molded or pressed plastic member for receiving and supporting said arms 50. Each slot may also have one or more strips of compressible material for providing a compression fit.

The front boards 32 are arranged to abut each other or are slightly spaced apart to form the slots 24. Since the outer layer 36 is wrapped around to the back of each inner core 34 as shown, each slot 24 is lined with the material of the outer layer 36. The size of the slot opening between adjacent front boards 32 is chosen by considering the compressibility of the material of the outer layer 36, the thickness T of the rear end 52 of the arm 50 and the desired intensity of the compression fit in each slot. If a tighter compression fit is required, then the slot opening is decreased slightly; conversely, if a looser fit is required, then the opening is increased slightly.

In one configuration, all of the front boards 32 have the same cross-sectional shape to provide a substantially planar front face 22. It will be appreciated that different surface effects on the front face 22 may be achieved by, say, providing front boards of different cross-sections. However, the choices are constrained by the need to create slots 24 having an adequate compression fit (i.e. the arms 50 must be properly supported in each slot) to retain the arms 50 in the display panel 20. In the embodiment of FIG. 3, each slot 24 provides about a 1.0 in. deep cavity to accept the rear end 52 of each arm 50.

It will further be appreciated that the cross sections of the boards 32 may be such that the slots 24 (as viewed in FIG. 3) are angled from the horizontal either upwardly or downwardly to achieve a desired display effect or to fit an unusually shaped arm 50, for example. Again, a constraint is that the rear end 52 of the arm 50 is able to fit into the slot 24 and is adequately retained therein.

Figure 4:
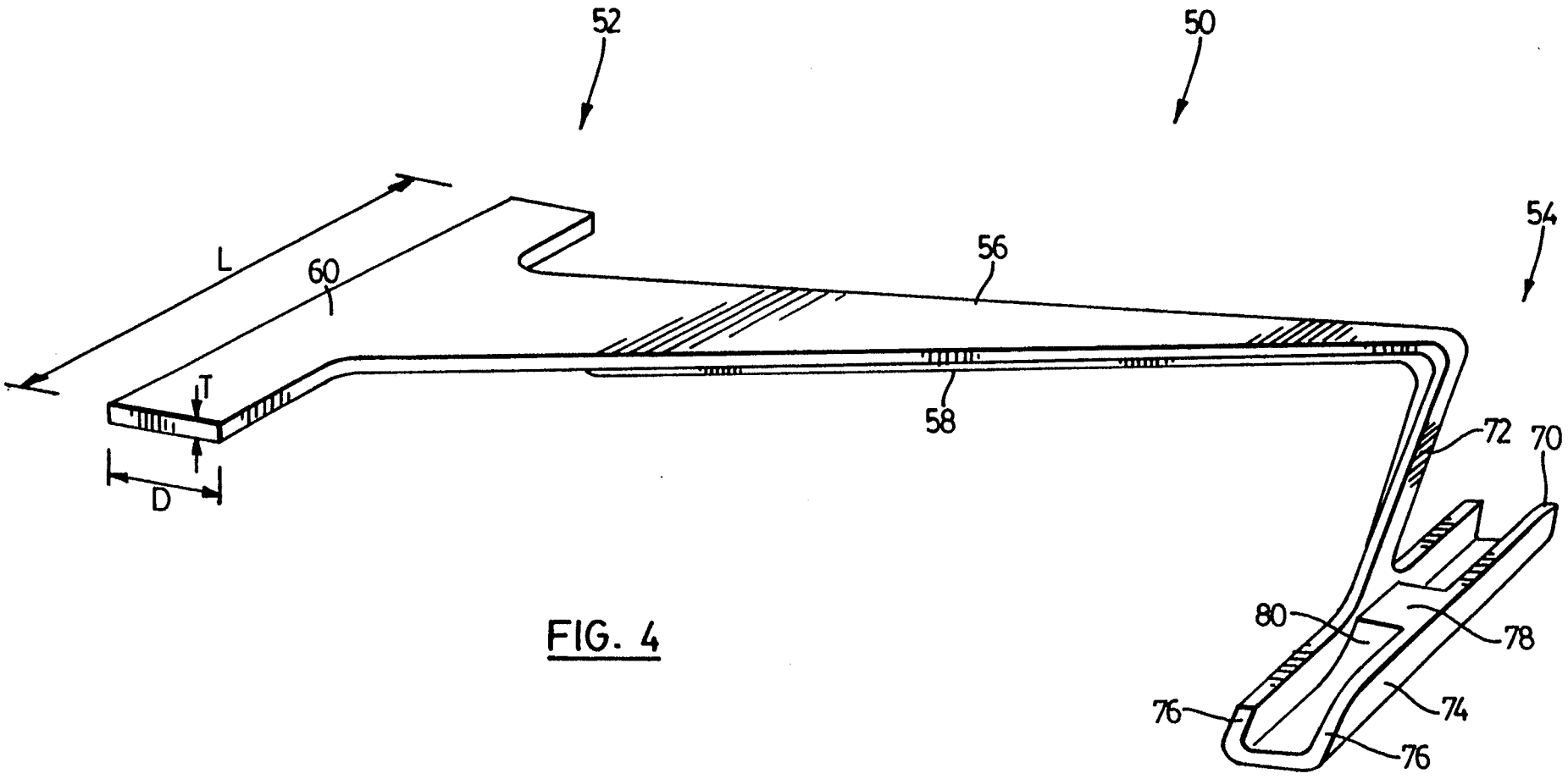
FIG. 4 is an isometric view of the arm of FIG. 3.
Figure 5:
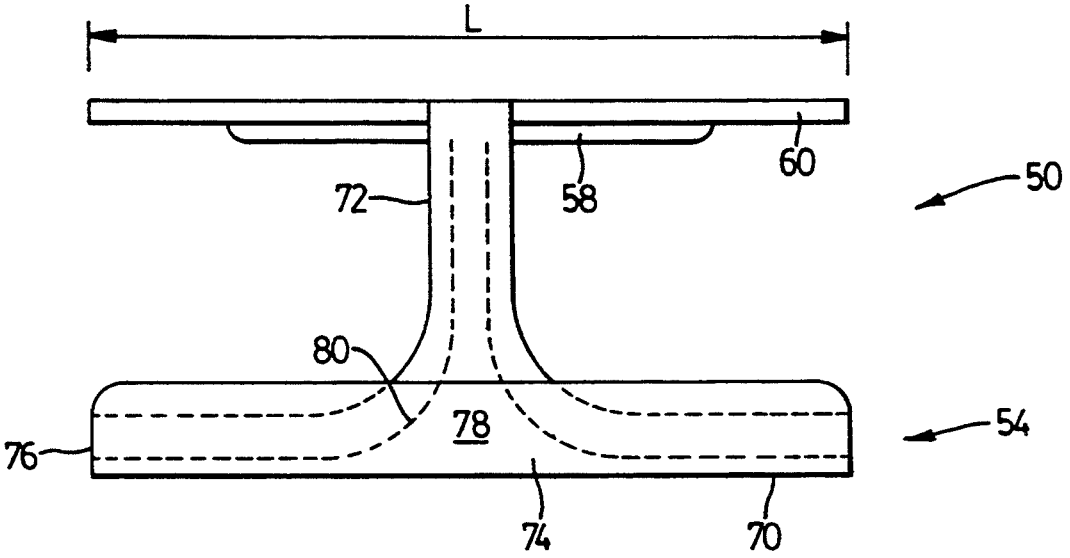
FIG. 5 is an end view, from the front, of the arm of FIG. 4.
Figure 6:
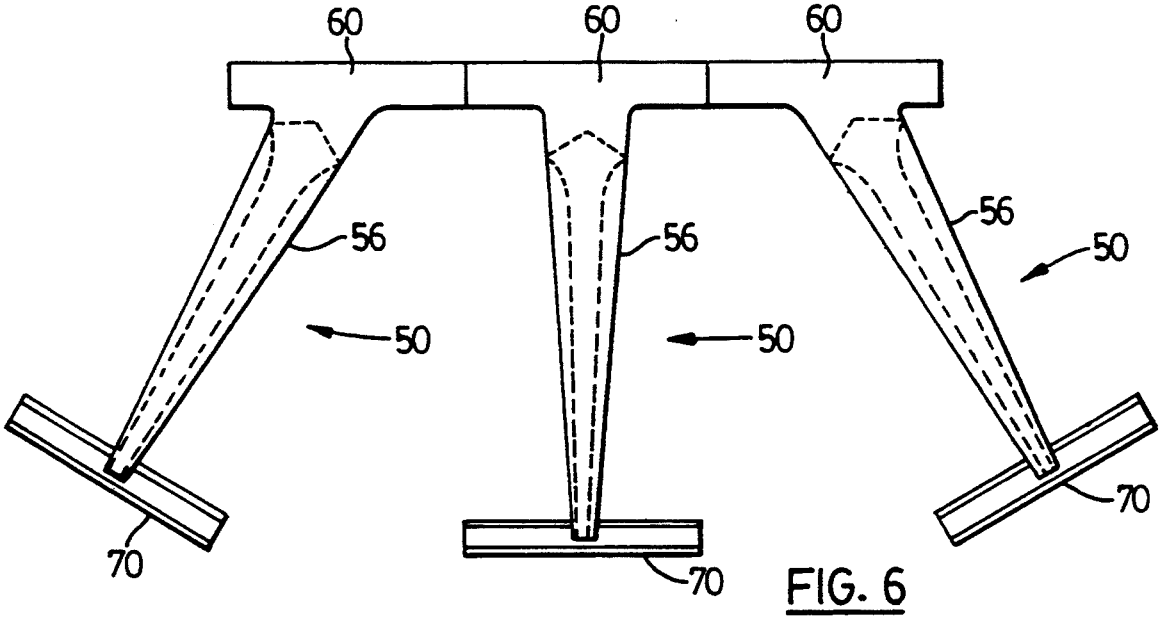
FIG. 6 is a top plan view of the arm of FIG. 4 and two other embodiments of said arm.

Turning now to FIGS. 4 to 6, the arm 50 will now be described in greater detail. The arm 50 comprises a longitudinal intermediate portion 56 having an integral gripping member or flange 60 at the rear end 52 and an integral holder 70 at the front end 54 adapted to receive the eyeglasses 1. The flange 60 has a slender profile for mating with the slots 24 on the panel 20 in a compression fit.

The length L of the flange 60 should be adequate to prevent the arm 50 from appreciably twisting when eyeglasses 1 are placed in the holder 70. However, the flange 60 of each arm 50 advantageously also functions as a "spacer" to provide a predetermined minimum lateral spacing between arms 50 (as shown in FIG. 6, for example). Preferably, as shown in the FIG. 5 embodiment, the distance L of the flange should be at least equal to or greater than the width of the holder 70 to prevent overlap of holders 70 of like adjacent arms and to provide an aesthetically pleasing consistent spacing of the arms 50 across a slot 24. The predetermined, i.e. "automatic", spacing between the arms provides enough lateral clearance between the eyeglasses on adjacent arms to help avoid the undue entanglement of the eyeglass frames, and gives an uncrowded look to the display panel 20. It will be appreciated that this spacing function can also be achieved using individual spacers (not shown) which are insertable in the slots 24 between the flanges 60 of adjacent arms 50. The spacers can be of differing lengths to vary the spacing between adjacent arms 50. Each spacer should include a means for removing it from the slot, for example, a string or short handle attached to the spacer and extending out of the slot 24 for pulling the spacer out.

The depth D of the flange 60 should be adequate to prevent the arm 50 from bending or twisting downwardly and dislodging from the slot 24 when eyeglasses 1 are placed in the holder 20. In the preferred embodiment, the flange 60 should keep the intermediate portion 56 of the arm 50 relatively perpendicular to the front face 22. Preferably, for aesthetic reasons, the depth D of the flange 60 is equal to or slightly less than the depth of the slot 24 so that most or all of the flange 60 is hidden in the slot 24 and obscured from view of the front face 22 of the panel 20. It will be appreciated that the flange 60 and/or the portion 56 may be kinked or have a step for abutting the front face 22 to provide additional support for the arm 50 in the slot 24.

In the preferred embodiment of the display system 10 described above, good results have been achieved using an arm 50 design having a flange 60 with a thickness T of about ⅛ inch (3.0 mm), a length L of about 4.0 inches (101.6 mm) and a depth D of about 1.0 inch (25.4 mm).

In one version of the arm 50 in the preferred embodiment (seen in FIGS. 4 and 5, and the center arm on FIG. 6) the intermediate portion 56 is co-planar with and perpendicular to the flange 60, and the arm 50 is adapted to extend orthogonally from the front face 22 when the arm 50 is inserted into the slot 24. Hence, someone standing in front of the panel 20 will view the displayed eyeglasses head on. In another version, the intermediate portion 56 may be angled relative to the flange 60 as illustrated in FIG. 6. This versatility allows the eyeglasses 1 to be displayed on the panel 20 in various configurations and provides a side view of the displayed eyeglasses to someone standing in front of the panel 20. It will be appreciated that the intermediate portion 56 may also be angled upwardly or downwardly, if desired, as long as the holder 70 is properly oriented to keep the eyeglasses 1 seated thereon.

In the configuration of the intermediate portion 56 shown in the figures, an integral reinforcing rib 58 extends beneath the portion 56 along its length to add flexural stiffness to the arm 50. Depending on the configuration of the portion 56 (i.e. its length, width, thickness and structural material), a rib or comparable reinforcement means need or need not be provided.

Referring now to the holder 70 at the front end 54 of the arm 50, the holder 70 in this embodiment comprises a support 72 extending downwardly from the intermediate portion 56 and a U-shaped channel 74 at the lower end of the support 72 adapted to receive the lower lens portion of the eyeglasses 1. When the eyeglasses 1 are inserted onto the holder 70 in an open position (i.e. with the arms of the eyeglasses extending along either side of the intermediate portion 56 toward the flange 60 as illustrated in FIG. 1), the bridge of the eyeglass frame rests against the support 72 while the upturned side walls 76 of the channel 74 prevent the lens portions from slipping off the holder forwardly or backwardly. The holder 70 also includes an upturned obstruction or wedge 78 at about the center of the channel 74 to prevent the eyeglass frame from slipping laterally out of the channel 74. The wedge 78 may have curved side faces 80 which roughly follow the contours of the lens portions of the eyeglasses 1. Hence, the holder 70 provides a means of securely retaining the eyeglasses on the arm with minimal or no interference with their display.

It will be appreciated that there is a wide latitude to the design of support 72. For example, the angle between the support 72 and intermediate portion 56 will vary to keep the channel walls 76 generally upright if the inclination of the portion 56 is altered. Likewise, in alternate versions, the support 72 may extend upwardly to locate the channel 74 above the intermediate portion 56, or the support 72 may be omitted entirely if the channel 74 extends directly from the portion 56. In the preferred embodiment, the rib 58 extends along the spine of the support 72 for added flexural strength.

In the preferred embodiment the flange 60, intermediate portion 56 and holder 70 are of one piece construction and are made of acrylic/lexan or polycarbonate. The arm 50 is produced in a blow molding process.

It can now be appreciated that the display system 10 according to the present invention provides a simple and efficient means of setting up an aesthetically pleasing display of eyeglasses. The arms 50 can be quickly and easily mounted on the panel 20 by merely pressing the flanges 60 into the slots 24, and the compression fit holds the arms 50 in place. The arms 50 may also be slid laterally to any desired location in a slot while maintaining the compression fit. Different combinations of arms 50 may be used (for example one combination is shown in FIG. 6) to form a wide variety of display patterns on the panel 20. As the display patterns are formed, the flanges 60 automatically provide a minimum spacing between adjacent arms 50 to space the eyeglasses being displayed and avoid their entanglement. The holder 70 also incorporates a wedge 78 to help center the eyeglasses on the holder 70 and to avoid lateral slippage of the glasses off of the holder 70.

The display system 10 may be described as being "modular" because each panel 20 can be considered to comprise a "module". A series of such modules, which can vary in shape and size, can be manufactured separately and then shipped to a retail outlet and set up to form a complete display system. Depending on particular display requirements, one "module" can comprise an entire display system.

It will be appreciated by those skilled in the art that the foregoing description relates to preferred embodiments and that other modifications are possible within the broad scope of the appended claims. Some modifications have been discussed above and others will be apparent to those skilled in the art. For instance, the display system 10 may be modified to support and display various other objects ranging from jewelry, to shoes, to small hardware items.

We claim:

1. A display system comprising:

(i) a plurality of elongate arms, each of the arms comprising:
  (a) a flange at one end;
  (b) a holder at the other end for receiving, supporting and retaining an eyeglass frame; and
  (c) a longitudinal intermediate portion between the flange and the holder;

(ii) a display panel comprising:
  (a) a generally upright front face; and
  (b) a plurality of slots in the panel accessible from said front face, each slot extending at least partly across the front face of said panel for receiving and holding the flanges of at least two of the arms in a compression fit, thereby removably retaining and supporting each holder in a spaced relationship from said front face;

(iii) the flange having a lateral width to provide a clear, pre-set, lateral spacing between the intermediate portions of two adjacent arms in a given slot; and (iv) said holder comprising:
  (a) a U-shaped channel opened upwardly for receiving the eyeglass frame therein;
  (b) a support for the eyeglass frame extending between the intermediate portion of the arm and the U-shaped channel to allow the top of said frame in said channel to recline toward the front face of the display panel; and
  (c) a raised portion intermediate the ends of the channel to prevent the frame from sliding along the channel;

wherein each arm is inserted and removed from the slots independently of the other arms by pushing or pulling the flange into and away from the slot, and wherein each arm is slideable laterally in the slot when fully inserted therein and while maintaining the compression fit.

2. The display system of claim 1 wherein the support extends downwardly from the intermediate portion of the arm and the U-shaped channel is located beneath a longitudinal axis of the intermediate portion.

3. The display system of claim 2 wherein said support extends from an upstanding side of the channel adjacent said raised portion and closest to said flange.

4. The display system of claim 3 wherein the longitudinal axis of the U-shaped channel is perpendicular to said longitudinal axis of the intermediate portion.

5. The display system of claim 1 wherein the intermediate portion extend orthogonally from said front face upon said arm being mounted in said slot.

6. The display system of claim 1 wherein said intermediate portion forms an acute angle with said front face upon said arm being mounted in said slot, said acute angle lying in a plane containing the longitudinal axes of said slot and said intermediate portion of the arm.

7. The display system of claim 6 wherein said plane is substantially horizontal.

8. The display system of claim 1 wherein some of the slots in the panel are spaced substantially parallel to some other of said slots.

9. The display system of claim 8 wherein said spacing of said slots is adapted to avoid interference between objects supported on arms located in neighboring slots.

10. The display system of claim 9 wherein said slots extend substantially horizontally.

11. The display system of claim 10 wherein said panel comprises:

(i) a backing; and (ii) a plurality of elongate front members connected to said backing and spaced from one another to form said slots.

12. The display system of claim 11 wherein said slots are spaced apart at least 75 mm.

13. The display system of claim 12 wherein each of said front members comprise an inner core substantially surround by an outer layer of relatively compressible material, wherein said outer layer is located on said core adjacent said slots to provide said compression fit.

14. The display system of claim 13 wherein said compressible material comprises one of fine hook material and fine loop material.

15. The display system of claim 1 wherein the lateral length of said flange is substantially equal to or greater than the lateral length of the holder.

* * * * *